US011557850B1

(12) United States Patent
Cavallieri et al.

(10) Patent No.: US 11,557,850 B1
(45) Date of Patent: Jan. 17, 2023

(54) HEADER POWER CONNECTOR

(71) Applicants: TE Connectivity Services GmbH, Schaffhausen (CH); TE CONNECTIVITY BRASIL INDUSTRIA DE ELECTRONICOS LTDA, Braganca Paulista (BR)

(72) Inventors: Amadeu Luiz Fazani Cavallieri, Campinas (BR); David James Rhein, Memphis, MI (US)

(73) Assignees: Tyco Electronics Shanghai CO Ltd.; TE Connectivity Solutions GmbH

( * ) Notice: Subject to any disclaimer, the term of this patent is extended or adjusted under 35 U.S.C. 154(b) by 22 days.

(21) Appl. No.: 17/368,416

(22) Filed: Jul. 6, 2021

(51) Int. Cl.
*H01R 13/506* (2006.01)
*H01R 13/405* (2006.01)

(52) U.S. Cl.
CPC ..... *H01R 13/506* (2013.01); *H01R 13/405* (2013.01); *H01R 2201/26* (2013.01)

(58) Field of Classification Search
None
See application file for complete search history.

(56) References Cited

U.S. PATENT DOCUMENTS

| | | | | |
|---|---|---|---|---|
| 10,622,733 | B2 * | 4/2020 | Sakakura | H01R 9/16 |
| 2004/0166744 | A1 * | 8/2004 | Inaba | H01R 13/432 439/843 |
| 2014/0198475 | A1 * | 7/2014 | Menzies | H05K 7/1432 361/811 |
| 2018/0342833 | A1 * | 11/2018 | Yokoyama | H01R 13/42 |
| 2020/0313357 | A1 * | 10/2020 | Iizuka | H01R 13/648 |

* cited by examiner

*Primary Examiner* — Oscar C Jimenez

(57) ABSTRACT

A header power connector includes a header housing assembly including an inner housing received in a cavity of an outer housing. The inner housing has upper and lower openings open to a terminal cavity configured to receive busbars. The inner housing is movable relative to the outer housing to accommodate misalignment of the busbars in the terminal cavity. A terminal is received in the terminal cavity having a terminal base, an upper mating end and a lower mating end. The upper mating end includes an upper socket flanked by upper spring beams that receives the first busbar and the lower mating end includes a lower socket flanked by lower spring beams that receives the second busbar. The terminal is movable in the terminal cavity to accommodate misalignment of the first busbar and the second busbar in the terminal cavity.

20 Claims, 12 Drawing Sheets

HEADER POWER CONNECTOR

BACKGROUND OF THE INVENTION

The subject matter herein relates generally to header power connectors.

Power connectors are used to transfer power between electrical components. For example, in an electric vehicle, a power connector is used to electrically connect an inverter with an electric motor. Typically, the power is supplied by coupling a cable mounted plug connector to a header power connector. The plug connector may be manipulated and moved into position for mating with the header power connector. The plug connector increases overall cost of the system being an extra component extending between the electrical components. There is a desire to directly couple the electrical components to the header power connector, such as to eliminate the plug connector and thus reduce the number of components and the cost of the system. However, alignment of the electrical components with the header power connector is difficult and may lead to improper mating and damage to the components.

A need remains for a header power connector having improved mating tolerances.

BRIEF DESCRIPTION OF THE INVENTION

In one embodiment, a header power connector is provided and includes a header housing assembly including an upper housing portion and a lower housing portion. The upper housing portion includes a busbar cavity including busbar cavities. The lower housing portion includes terminal cavities has ports open to the terminal cavities configured to receive first busbars associated with a first electrical component. The header power connector includes terminals received in the corresponding terminal cavities. Each terminal includes an upper mating end having an upper socket and a lower mating end having a lower socket. The lower socket is configured to receive the corresponding first busbar to electrically connect the terminal to the first busbar. The header power connector includes a header busbar assembly received in the header housing assembly between the upper housing portion and the lower housing portion. The header busbar assembly includes header busbars and a header busbar positioner coupled to the header busbars to position the header busbars relative to each other. Each header busbar includes a mating tab at a mating end and a terminating tab at a terminating end opposite the mating end. The mating tab extends into the terminal cavity to mate with the corresponding terminal. The terminating tabs pass through the busbar cavities and extends from the upper housing portion for connection to second busbars associated with a second electrical component. The header busbars and the terminals are configured to electrically connect the first busbars and the second busbars. The header power connector includes busbar seals received in the busbar cavities to seal against the header busbars and seal against the upper housing portion.

In another embodiment, a header power connector is provided and includes a header housing assembly including an upper housing portion and a lower housing portion. The upper housing portion includes a busbar cavity including busbar cavities. The lower housing portion includes terminal cavities having ports open to the terminal cavities configured to receive first busbars associated with a first electrical component. The header power connector includes terminals received in the corresponding terminal cavities. Each terminal includes an upper mating end having an upper socket and a lower mating end having a lower socket. The lower socket is configured to receive the corresponding first busbar to electrically connect the terminal to the first busbar. The header power connector includes a header busbar assembly received in the header housing assembly between the upper housing portion and the lower housing portion. The header busbar assembly includes header busbars and a header busbar positioner coupled to the header busbars to position the header busbars relative to each other. Each header busbar includes a mating tab at a mating end and a terminating tab at a terminating end opposite the mating end. The mating tab extends into the terminal cavity to mate with the corresponding terminal along a first tab axis. The terminating tabs pass through the busbar cavities along a second tab axis offset from the first tab axis. The terminating tabs extends from the upper housing portion for connection to second busbars associated with a second electrical component. The header busbars and the terminals are configured to electrically connect the first busbars and the second busbars.

In a further embodiment, a header power connector is provided and includes a header housing assembly including an upper housing portion and a lower housing portion. The upper housing portion includes a busbar cavity including busbar cavities. The lower housing portion includes an inner housing portion and an outer housing portion. The inner housing portion is separate and discrete from the outer housing portion and is coupled to the outer housing portion. The outer housing portion is integral with the upper housing portion. The inner housing portion includes terminal cavities having ports open to the terminal cavities configured to receive first busbars associated with a first electrical component. The header power connector includes terminals received in the corresponding terminal cavities and held between the inner housing portion and the outer housing portion. Each terminal includes an upper mating end having an upper socket and a lower mating end having a lower socket. The lower socket is configured to receive the corresponding first busbar to electrically connect the terminal to the first busbar. The header power connector includes a header busbar assembly received in the header housing assembly between the upper housing portion and the lower housing portion. The header busbar assembly includes header busbars and a header busbar positioner coupled to the header busbars to position the header busbars relative to each other. Each header busbar includes a mating tab at a mating end and a terminating tab at a terminating end opposite the mating end. The mating tab extends into the terminal cavity to mate with the corresponding terminal. The terminating tabs pass through the busbar cavities and extend from the upper housing portion for connection to second busbars associated with a second electrical component. The header busbars and the terminals are configured to electrically connect the first busbars and the second busbars.

DETAILED DESCRIPTION OF THE INVENTION

Figure 1:
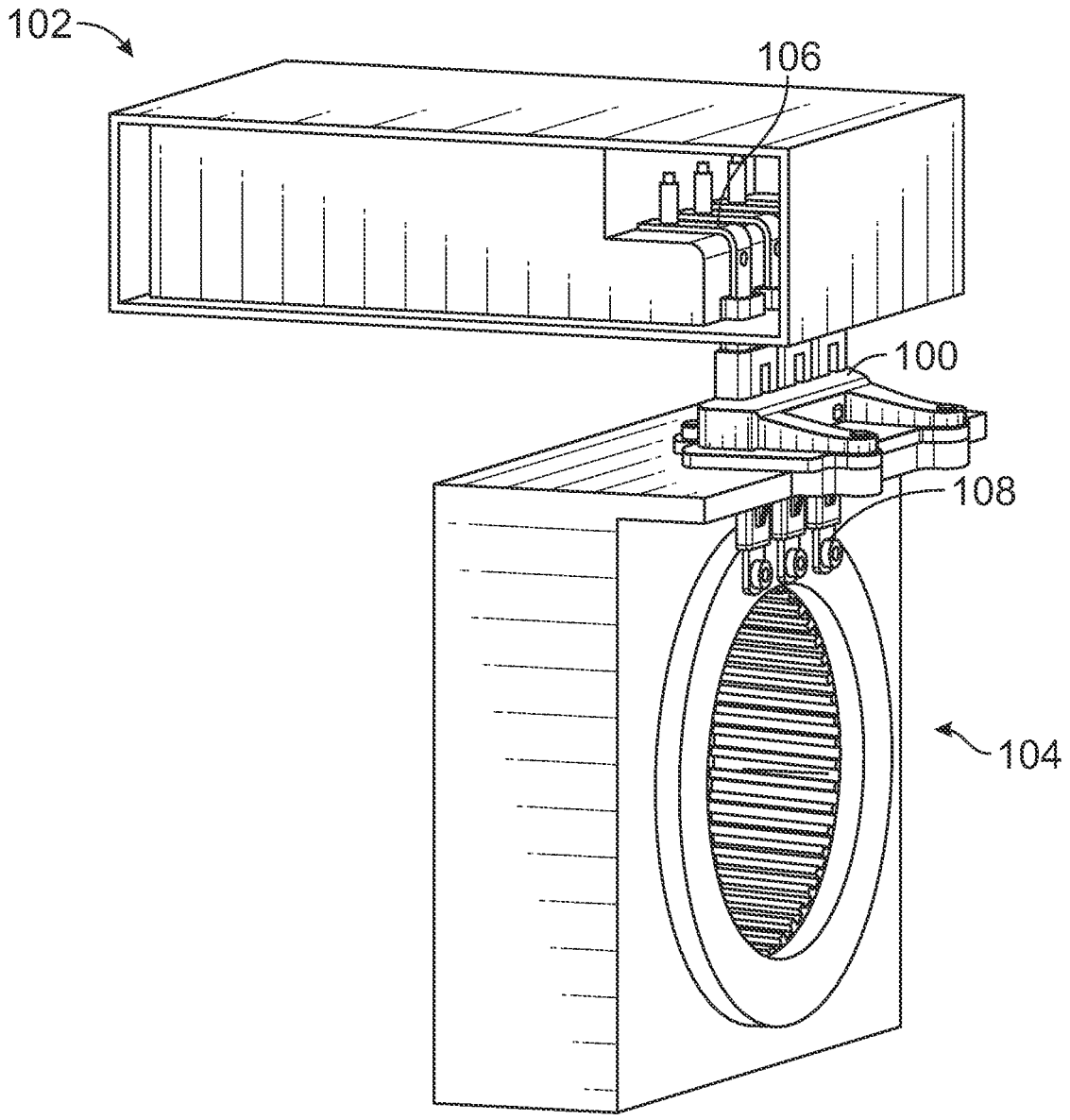
FIG. 1 is a schematic view of a header power connector in accordance with an exemplary embodiment.

FIG. 1 is a schematic view of a header power connector 100 in accordance with an exemplary embodiment. The header power connector 100 is used to electrically connect a first electrical component 102 and a second electrical component 104. The header power connector 100 is located between the first electrical component 102 and the second electrical component 104. In various embodiments, the first and second electrical components 102, 104 may be part of an electric vehicle. For example, the first electrical component 102 may be an inverter and the second electrical component 104 may be an electric motor. The header power connector 100 may be used to electrically connect other types of electrical components in alternative embodiments.

In an exemplary embodiment, the first electrical component 102 includes a first busbar 106 and the second electrical component 104 includes a second busbar 108. The header power connector 100 electrically connects the first and second busbars 106, 108 to transmit power between the first and second electrical components 102, 104. In an exemplary embodiment, the header power connector 100 is mounted to the first electrical component 102 and the header power connector 100 is mated with the second busbars 108 when the first electrical component 102 is coupled to the second electrical component 104. For example, the second busbars 108 are plugged into the header power connector 100 when the first electrical component 102 is coupled to the second electrical component 104. Optionally, the header power connector 100 may be blind mated with the second busbars 108 when the first electrical component 102 is coupled to the second electrical component 104.

The first busbars 106 are metal plates, such as copper plates. The first busbars 106 have mating interfaces at front and/or rear surfaces of the first busbars 106. The header power connector 100 may be coupled to the mating interfaces, such as by welding or securing using bolts. For example, header busbars of the header power connector 100 may be terminated to the mating interfaces of the first busbars 106. The second busbars 108 are metal plates, such as copper plates. The second busbars 106 have tabs or ends that are plugged into the header power connector 100 to electrically connect to header terminals (for example, sockets) of the header power connector 100. In the illustrated embodiment, the first electrical component 102 includes a plurality of the first busbars 106 and the second electrical component 104 includes a plurality of the second busbars 108.

Figure 2:
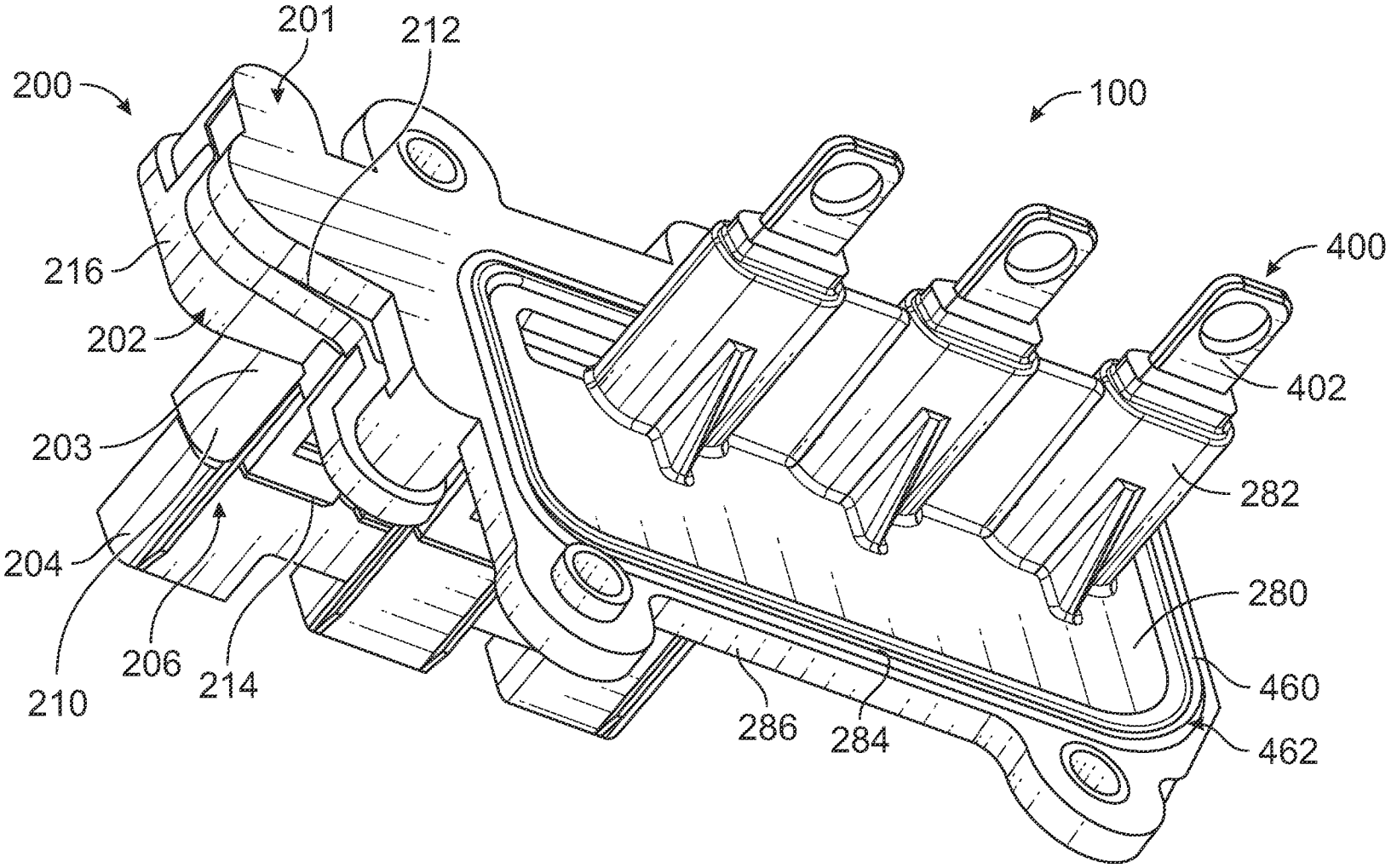
FIG. 2 is a top perspective view of the header power connector in accordance with an exemplary embodiment.
Figure 3:
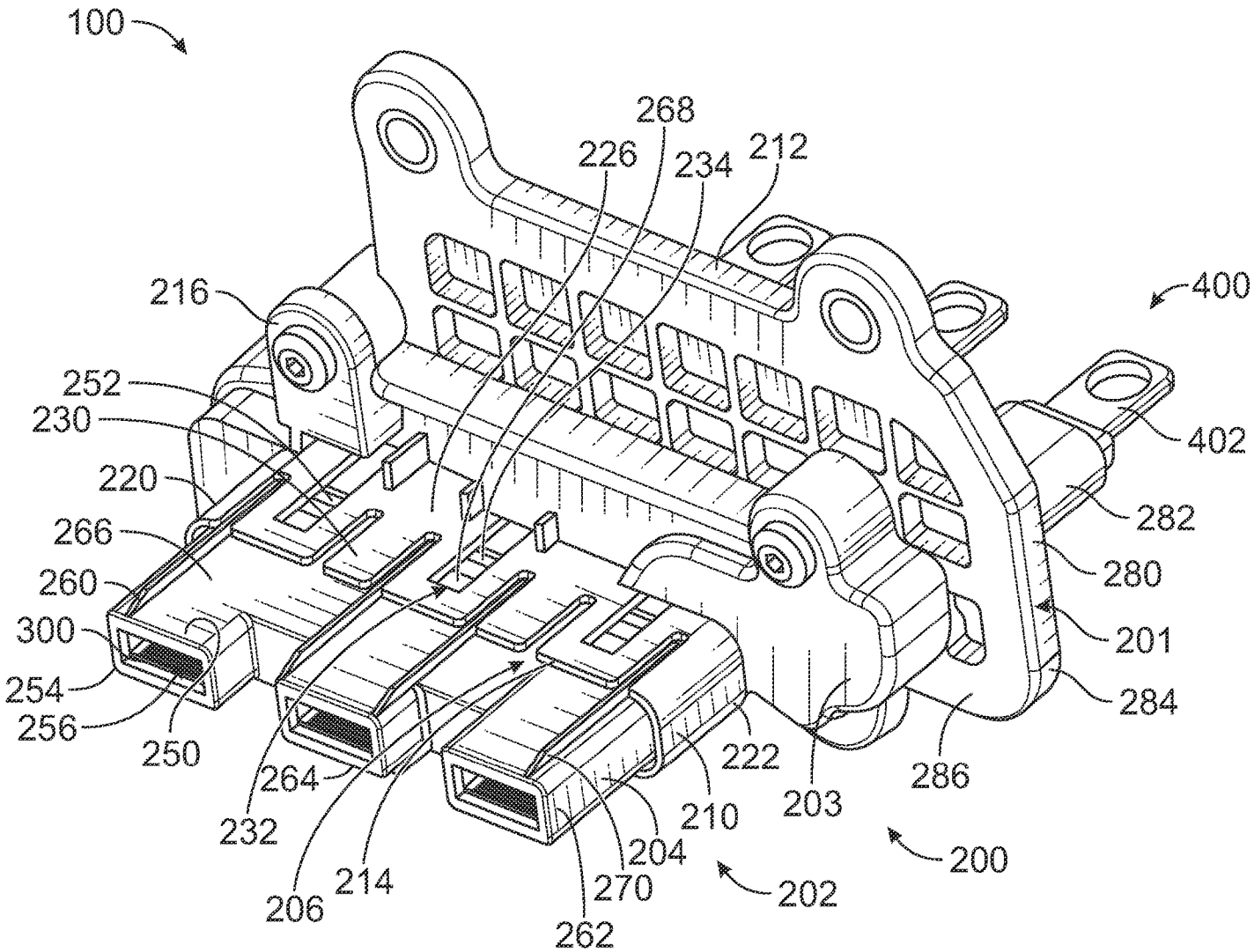
FIG. 3 is a bottom, rear perspective view of the header power connector in accordance with an exemplary embodiment.
Figure 4:
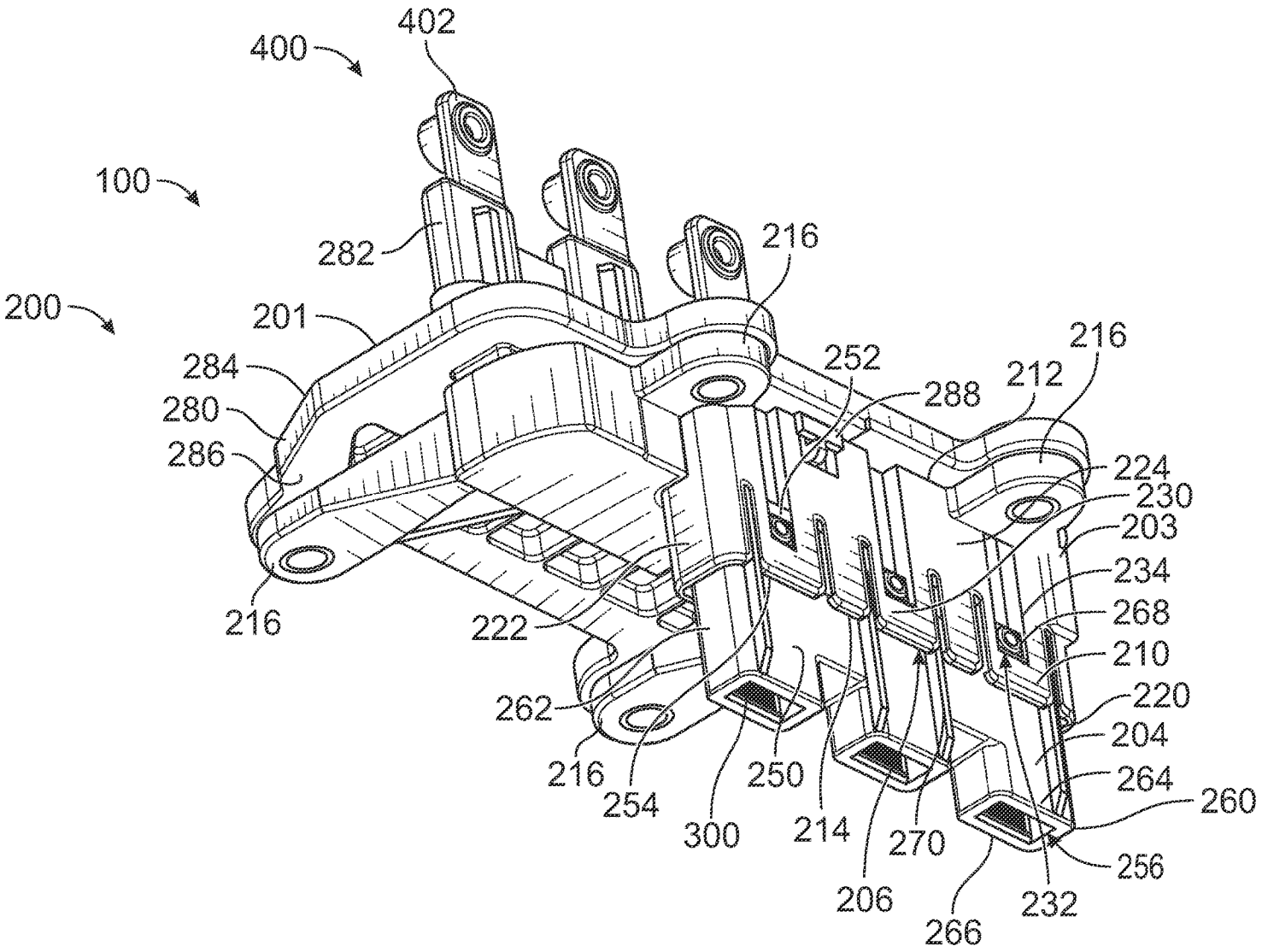
FIG. 4 is a bottom, front perspective view of the header power connector in accordance with an exemplary embodiment.

FIG. 2 is a top perspective view of the header power connector 100 in accordance with an exemplary embodiment. FIG. 3 is a bottom, rear perspective view of the header power connector 100 in accordance with an exemplary embodiment. FIG. 4 is a bottom, front perspective view of the header power connector 100 in accordance with an exemplary embodiment.

The header power connector 100 includes a header housing assembly 200 holding terminals 300 (shown in FIGS. 3 and 4) and a header busbar assembly 400. The header busbar assembly 400 includes header busbars 402 coupled to corresponding terminals 300. The header busbars 402 are configured to be coupled to corresponding first busbars 106 of the first electrical component 102 (shown in FIG. 1). The terminals 300 are configured to be coupled to corresponding second busbars 108 of the second electrical component 104 (shown in FIG. 1). The header busbar assembly 400 may include greater or fewer header busbars 402 (for example, a single busbar, a pair of busbars, five busbars, seven busbars, and the like) in alternative embodiments depending on the particular application.

The header housing assembly 200 includes an upper housing portion 201 and a lower housing portion 202. The lower housing portion 202 holds the terminals 300. In an exemplary embodiment, the upper housing portion 201 is configured to be mounted to one of the electrical components, such as the first electrical component 102 (shown in FIG. 1). The upper housing portion 201 supports the lower housing portion 202 relative to the first electrical component 102, such as for mating with the second busbars 108 of the second electrical component 104 when the first electrical component 102 is coupled to the second electrical component 104. The terms upper and lower are used herein in reference to the orientation illustrated in the figures. Other mounting orientations are possible in alternative embodiments.

In an exemplary embodiment, the header housing assembly 200 is a multipiece housing assembly. For example, the upper housing portion 201 is separate and discrete from the lower housing portion 202. The lower housing portion 202 is coupled to the upper housing portion 201 using fasteners. A seal or potting material may be included between the housing portions 201, 202 and/or around the header busbars 402. Alternatively, the upper housing portion 201 may be integral with the lower housing portion 202, such as being co-molded during a molding process. When co-molded, the header busbars 402 may be held by a tool during the molding process. The molded material may separate and hold the header busbars 402 relative to each other. The molded material may be sealed against the header busbars 402.

In an exemplary embodiment, the lower housing portion 202 is a multi-piece structure including an outer housing 203 and an inner housing 204. The inner housing 204 is received in a cavity 206 of the outer housing 203. The inner housing 204 holds the terminals 300. In an exemplary embodiment, the inner housing 204 is movable relative to the outer housing 203 to accommodate alignment and mating with the second busbars 108 of the second electrical component 104. For example, the inner housing 204 may be tilted are rotated within the outer housing 203 to accommodate misalignment of the header power connector 100 with the second busbars 108. The inner housing 204 has a limited amount of contained movement relative to the outer housing 203. The outer housing 203 is shaped to control and contained the movement of the inner housing 204 during mating. For example, the outer housing 203 may allow the inner housing 204 to rotate a predetermined amount to allow mating with the second busbars 108. In an exemplary embodiment, the terminals 300 may also have a limited amount of contained movement relative to the inner housing 204 to accommodate the misalignment of the second busbars 108 during mating.

The outer housing 203 includes an outer wall 210 surrounding the cavity 206. The outer wall 210 extends between an upper end 212 and a lower end 214 of the outer housing 203. In an exemplary embodiment, the upper end 212 is configured to be mounted to the upper housing portion 201. The outer housing 203 includes mounting flanges 216 at opposite sides 220, 222 of the outer housing 203. The mounting flanges 216 may receive fasteners to secure the outer housing 203 to the upper housing portion 201. FIGS. 3 and 4 illustrate different mounting locations for the mounting flanges 216 to secure the outer housing 203 to the inner housing 201. Other locations are possible in alternative embodiments. The outer housing 203 includes a front 224 and a rear 226 extending between the sides 220, 222. The cavity 206 is formed between the front 224 and the rear 226. The cavity 206 extends between the first side 220 and the second side 222. The cavity 206 is open to receive the inner housing 204. The outer housing 203 includes support walls 230 extending from the lower end 214 to support the inner housing 204 in the cavity 206. In an exemplary embodiment, the outer housing 203 includes latching features 232 used to secure the inner housing 204 to the outer housing 203. In various embodiments, the latching features 232 are formed in one or more of the support walls 230. In the illustrated embodiment, the latching features 232 are deflectable latching tabs configured to engage corresponding latching features of the inner housing 204. The latching features 232 may be openings 234 configured to receive the corresponding latching features of the inner housing 204. Other types of latching features may be used in alternative embodiments.

The inner housing 204 includes a plurality of inner walls 250 extending between an upper end 252 and a lower end 254. The inner walls 250 form terminal cavities 256 configured to receive corresponding terminals 300 therein. The terminal cavities 256 are open at the lower end 254 to receive the second busbars 108. The inner walls 250 guide the second busbars 108 into the terminal cavities 256 to mate with the terminals 300.

The inner housing 204 includes a first side 260 and a second side 262 opposite the first side 260. The inner housing 204 includes a front 264 and a rear 266 extending between the sides 260, 262. In an exemplary embodiment, the inner housing 204 includes latching features 268 extending from the front 264 and/or the rear 266. The latching features 268 are configured to interface with the latching features 232 of the outer housing 203 to secure the inner housing 204 in the cavity 206 of the outer housing 203. In the illustrated embodiment, the latching features 268 include latches each having a ramp surface and a catch surface. Other types of latching features may be provided in alternative embodiments. In an exemplary embodiment, the inner housing 204 includes positioning ribs 270 extending from the front 264 and/or the rear 266 to position the inner housing 204 relative to the outer housing 203. In an exemplary embodiment, the positioning ribs 270 are positioned in slots between the support walls 230 to locate the inner housing 204 relative to the outer housing 203.

The upper housing portion 201 is used to hold the header busbar assembly 400. The upper housing portion 201 includes a base 280 and towers 282 extending from a top 284 of the base 280. The towers 282 support the header busbars 402. The lower housing portion 202 is coupled to a bottom 286 of the base 280. In an exemplary embodiment, the upper housing portion 201 includes a latch 288 used to secure the lower housing portion 202 to the upper housing portion 201. The latch 288 is latchably coupled to the outer housing 203.

Figure 5:
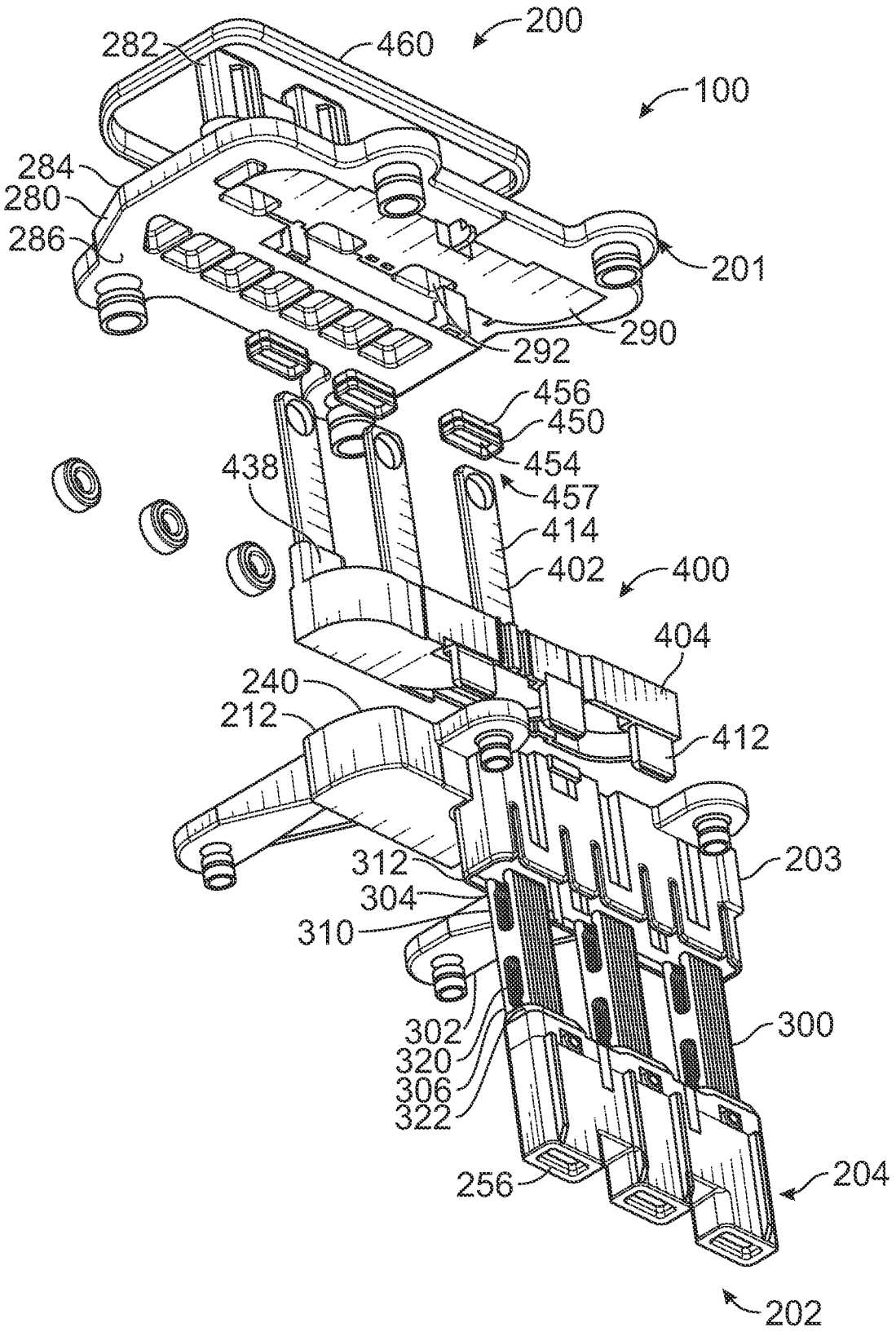
FIG. 5 is a bottom perspective, exploded view of the header power connector in accordance with an exemplary embodiment.

FIG. 5 is a bottom perspective, exploded view of the header power connector 100 in accordance with an exemplary embodiment. The header busbar assembly 400 is received in the header housing assembly 200 between the upper housing portion 201 and the lower housing portion 202. The upper housing portion 201 holds the header busbars 402. The lower housing portion 202 holds the terminals 300. The header busbars 402 are configured to mate with the terminals 300 within the header housing assembly 200.

The terminals 300 are configured to be held in the lower housing portion 202, such as between the outer housing 203 and the inner housing 204. In an exemplary embodiment, the terminals 300 are held together in terminal stacks. Each terminal stack is configured to be mated with a different header busbar 402 and configured to be mated with a different second busbar 108 (shown in FIG. 1). In an exemplary embodiment, each terminal 300 is a double ended socket terminal configured to receive the header busbar 402 and the second busbar 108 in opposite ends of the terminal 300. Other types of terminals may be used in alternative embodiments.

The terminal 300 is a stamped and formed terminal manufactured from a metal material, such as a copper material. The terminal 300 may have one or more plating layers, such as a nickel-plating layer and/or a gold plating layer. The terminal 300 includes a terminal base 302, an upper mating end 304 at a first side of the terminal base 302, and a lower mating end 306 at a second side of the terminal base 302. Optionally, the upper mating end 304 and the lower mating end 306 may be identical. The terminal 300 has an upper socket 310 at the upper mating end 304 flanked by upper spring beams 312. The terminal 300 includes a lower socket 320 at the lower mating end 306 flanked by lower spring beams 322. The spring beams 312, 322 may be deflectable when mated to the corresponding busbars. The spring beams 312, 322 having mating interfaces proximate to distal ends of the spring beams 312, 322.

The terminals 300 are configured to be loaded in the terminal cavities 256 of the inner housing 204 of the lower housing portion 202. The terminals 300 are configured to be captured between the inner housing 204 and the outer housing 203. For example, each terminal cavity 256 receives the corresponding terminal stack of the terminals 300. The terminals 300 are arranged side-by-side in the terminal stack. The terminals 300 function as a single terminal assembly within the terminal stack. The terminals 300 are independently movable relative to each other within the terminal stack. The terminals 300 may be stamped and formed from thin metal sheets and stacked together to increase the overall current carrying capacity of the terminal assembly.

In an exemplary embodiment, the lower housing portion 202 includes a pocket 240 at the upper end 212. The pocket 240 is configured to receive the header busbar assembly 400. For example, the pocket 240 receives a header busbar positioner 404 of the header busbar assembly 400. The pocket 240 may be open at the upper end 212 to receive the header busbar positioner 404. The upper housing portion 201 closes or caps the pocket 240 to retain the header busbar positioner 404 in the pocket 240. The header busbar positioner 404 supports and positions the header busbars 402 relative to each other and relative to the header housing assembly 200. For example, the header busbars 402 extend from the header busbar positioner 404 into the upper housing portion 201 and the lower housing portion 202.

Figure 6:
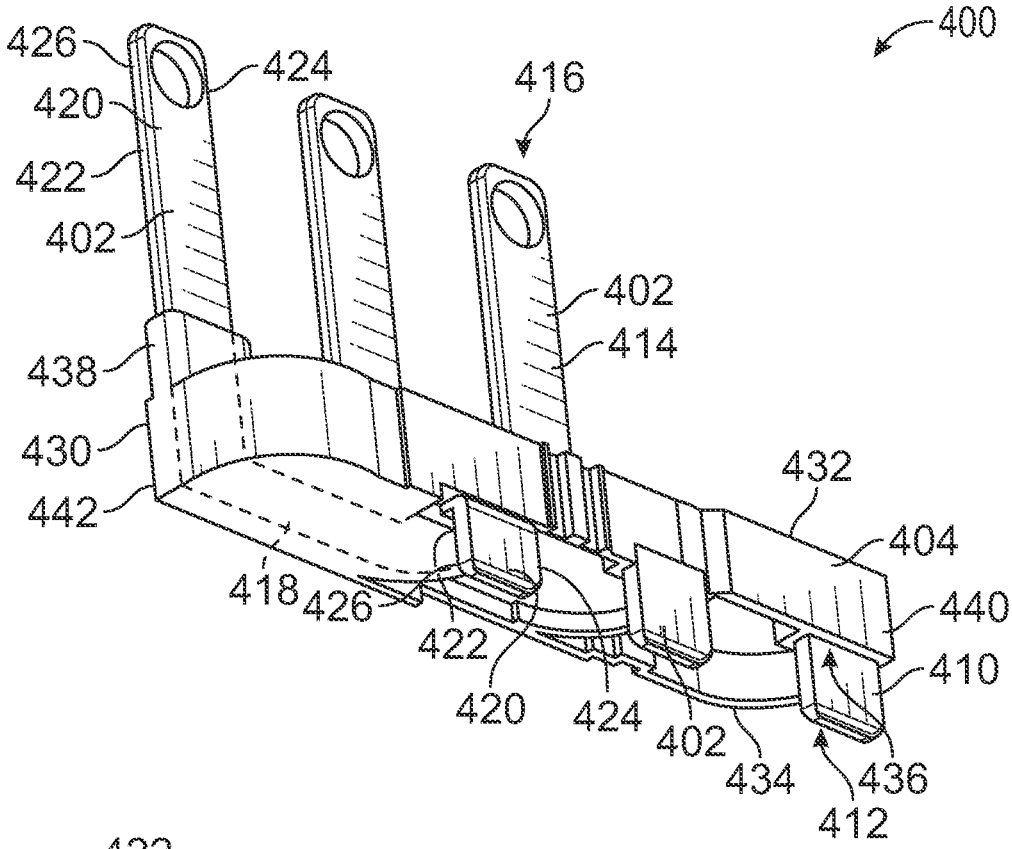
FIG. 6 is a front, bottom perspective view of the header busbar assembly in accordance with an exemplary embodiment.
Figure 7:
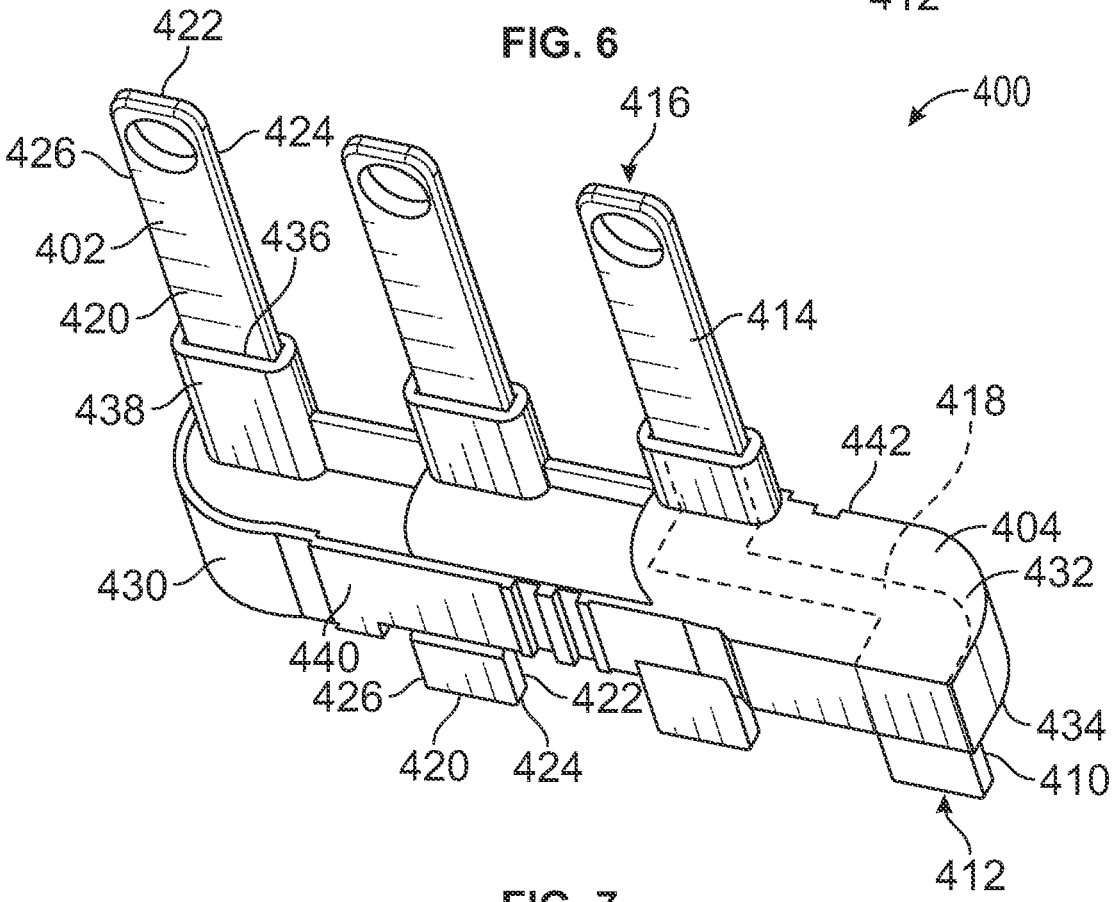
FIG. 7 is a rear, top perspective view of the header busbar assembly in accordance with an exemplary embodiment.
Figure 8:
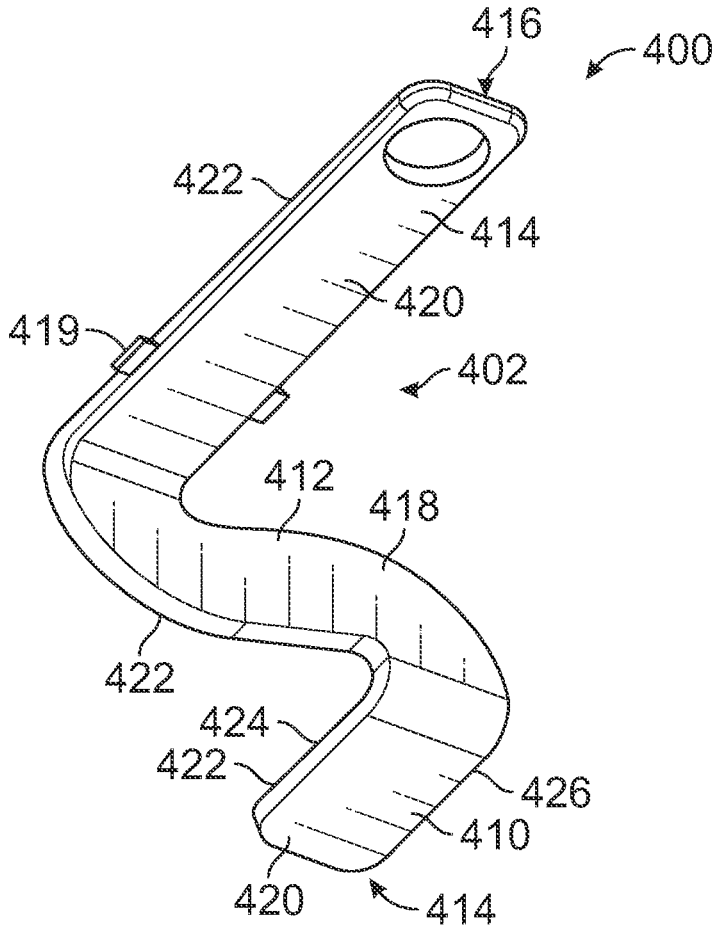
FIG. 8 is a perspective view of a portion of the header busbar assembly showing one of the header busbars in accordance with an exemplary embodiment.

FIG. 6 is a front, bottom perspective view of the header busbar assembly 400 in accordance with an exemplary embodiment. FIG. 7 is a rear, top perspective view of the header busbar assembly 400 in accordance with an exemplary embodiment. FIG. 8 is a perspective view of a portion of the header busbar assembly 400 showing one of the header busbars 402 in accordance with an exemplary embodiment.

Each header busbar 402 includes a mating tab 410 at a mating end 412 of the header busbar 402 and a terminating tab 414 at a terminating end 416 of the header busbar 402. In the illustrated embodiment, the mating tab 410 is at the bottom and the terminating tab 414 is at the top. The mating tab 410 is configured to be mated with the corresponding terminal 300 (shown in FIG. 5). For example, the mating tab 410 is configured to be plugged into the socket of the terminal 300. The terminating tab 414 is configured to be terminated to the second busbar 108 (shown in FIG. 1). For example, the terminating tab 414 may be welded or bolted to the second busbar 108. The header busbar 402 includes a transition portion 418 (shown in phantom in FIGS. 6 and 7) between the mating tab 410 and the terminating tab 414. Optionally, the terminating tab 414 may include retention tabs 419 extending from the sides of the terminating tab 414 used to retain the header busbar 402 in the housing.

In an exemplary embodiment, the header busbar 402 is a stamped and formed metal bar. In the illustrated embodiment, the mating tab 410 and the terminating tab 414 are offset from each other. The transition portion 418 transitions between the mating tab 410 and the terminating tab 414. The header busbar 402 includes multiple bends, such as between the transition portion 418 and the tabs 410, 414. The mating tab 410 may be offset in a first lateral direction (X direction) and/or in a second lateral direction (Y direction). In the illustrated embodiment, the mating tab 410 and the terminating tab 414 are offset in both lateral directions. For example, the mating tab 410 is shifted rearward relative to the terminating tab 414 and the mating tab 410 is shifted side-to-side relative to the terminating tab 414. For example, the mating tab 410 and the terminating tab 414 may be offset side-to-side such that the first side and the second side of the mating tab 410 are offset relative to the first side and the second side of the terminating tab 414. The mating tab 410 and the terminating tab 414 may additionally or alternatively be offset front-to-rear such that the front and the rear of the mating tab 410 are offset relative to the front and the rear of the terminating tab 414. In various embodiments, the mating tab 410 and the terminating tab 414 both extend vertically. For example, the mating tab 410 is oriented parallel to the terminating tab 414, but non-coplanar with the terminating tab 414. The transition portion 418 may be oriented generally perpendicular to the tabs 410, 414, such as being horizontal. The transition portion 418 may be curved between the tabs 410, 414. The header busbar 402 may have other shapes in alternative embodiments.

In an exemplary embodiment, the header busbar 402 includes a first surface 420 and a second surface 422 with first and second edges 424, 426 therebetween. The first surface 420 defines a front of the mating tab 410 and a front of the terminating tab 410 and the second surface defines a rear of the mating tab 410 and a rear of the terminating tab 410. The first surface 420 defines a top of the transition portion 418 and the second surface 422 defines a bottom of the transition portion 418.

The header busbar positioner 404 includes a dielectric body 430 having an upper surface 432 and a lower surface 434. The header busbar positioner 404 includes busbar channels 436 therethrough that receive corresponding header busbars 402. The header busbars 402 may extend from the upper surface 432 and from the lower surface 434 for electrical connection with other components, such as the second busbars 108 and the terminals 300. For example, the mating tabs 410 extend from the lower surface 434 and the terminating tabs 414 extend from the upper surface 432. In an exemplary embodiment, the header busbar positioner 404 includes extensions 438 that support the header busbars 402. In the illustrated embodiment, the extensions 438 extend form the upper surface 432 and support the terminating tabs 414.

The dielectric body 430 positions the header busbars 402 relative to each other. For example, the dielectric body 430 holds and fixes positions of the header busbars 402 relative to each other. The dielectric body 430 holds the transition portions 418 and may hold the mating tabs 410 and/or the terminating tabs 414. In the illustrated embodiment, the mating tabs 410 are located at a rear 440 of the dielectric body 430 and the terminating ends 414 are located at a front 442 of the dielectric body 430. The tabs 410, 414 may extend from other locations in alternative embodiments. The dielectric body 430 electrically isolates the header busbars 402 from each other. In an exemplary embodiment, the dielectric body 430 is molded around the header busbars 402 (such as around a spacer plate or substrate holding the header busbar 402) to retain the header busbars 402. In alternative embodiments, the dielectric body 430 may be pre-molded and the header busbars 402 loaded into the dielectric body 430. The dielectric body 430 may be multiple pieces assembled around the header busbars 402. In other alternative embodiments, the dielectric body 430 may be manufactured from multiple pieces, such as sheets or plates, that are positioned between the header busbars 402.

Figure 9:
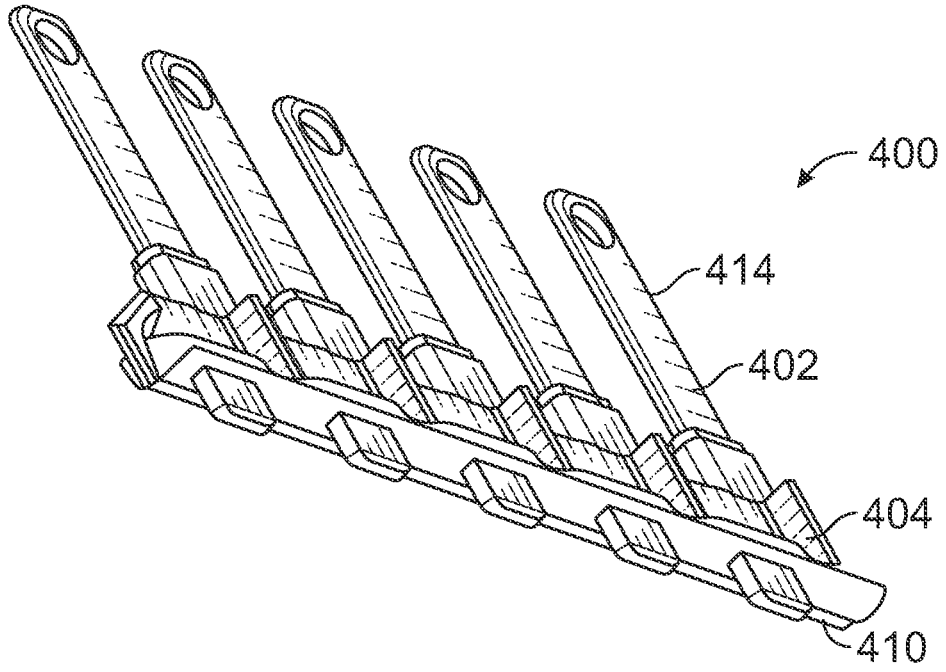
FIG. 9 is a perspective view of the header busbar assembly in accordance with an exemplary embodiment.

FIG. 9 is a perspective view of the header busbar assembly 400 in accordance with an exemplary embodiment. In the illustrated embodiment, the header busbars 402 pass straight through the header busbar positioner 404. The header busbars 402 are planar rather than having bends. The mating and terminating tabs 410, 414 are coplanar rather than being offset. Any number of header busbars 402 may be held by the header busbar positioner 404. For example, in the illustrated embodiment, the header busbar positioner 404 holds five header busbars 402 rather than the three header busbars 402 illustrated in FIG. 6. The header busbar assembly 400 may include greater or fewer header busbars 402 in alternative embodiments and may be scaled based on the particular application.

Returning to FIG. 5, during assembly, the header busbar assembly 400 is positioned between the upper housing portion 201 and the lower housing portion 202. The header busbar positioner 404 is received in the pocket 240. The mating tabs 410 are aligned with the cavity 206 of the lower housing portion 202. For example, the mating tabs 410 are received in the terminal cavities 256 to mate with the corresponding terminals 300. The terminating tabs 414 extend from the extensions 438. The terminating tabs 414 are configured to extend into the upper housing portion 201.

The upper housing portion 201 includes a pocket 290 at the bottom 286 of the base 280 that receives the header busbar positioner 404. The upper housing portion 201 includes busbar cavities 292 through the base 280. The busbar cavities 292 extend through the towers 282. The busbar cavities 292 receive the terminating tabs 414. In an exemplary embodiment, the busbar cavities 292 receive the extensions 438.

In an exemplary embodiment, the header busbar assembly 400 includes busbar seals 450 received in the busbar cavities 292 to seal against the header busbars 402 and the upper housing portion 201. The busbar seals 450 provide sealing through the interior of the header power connector 100. The busbar seal 450 may be a polymer material, such as a rubber material (for example, nitrile rubber, fluoro rubber), polytetrafluoroethylene (PTFE), or other sealing material. The busbar seal 450 includes an opening 452 defined by an interior surface 454. The opening 452 receives the terminating tab 414 of the header busbar 402. The interior surface 454 seals against the surfaces of the terminating tab 414. The busbar seal 450 includes an exterior surface 456. The exterior surface 456 seals against the interior surface of the upper housing portion 201 defining the busbar cavity 292. The busbar seals 450 prevent leakage or flow through the busbar cavities 292. The busbar seal 450 may engage the extension 438. For example, an end of the busbar seal 450 and seal against the end of the busbar seal 450. In alternative embodiments, the busbar seals 450 may be formed in place in the busbar cavities 292. For example, the busbar seals 450 may be potting material or injection molding material molded in place in the busbar cavities 292 around the header busbars 402.

In an exemplary embodiment, the header power connector 100 includes a component seal 460 coupled to the upper housing portion 201. The component seal 460 is configured to be sealingly coupled to an exterior seal surface 462 (shown in FIG. 2) of the upper housing portion 201. The exterior seal surface 462 is at the top 284 of the base 280. The exterior seal surface 462 may be provided in a seal well or pocket at the top 284. The component seal 460 is configured to seal against the first electrical component 102 (shown in FIG. 1).

Figure 10:
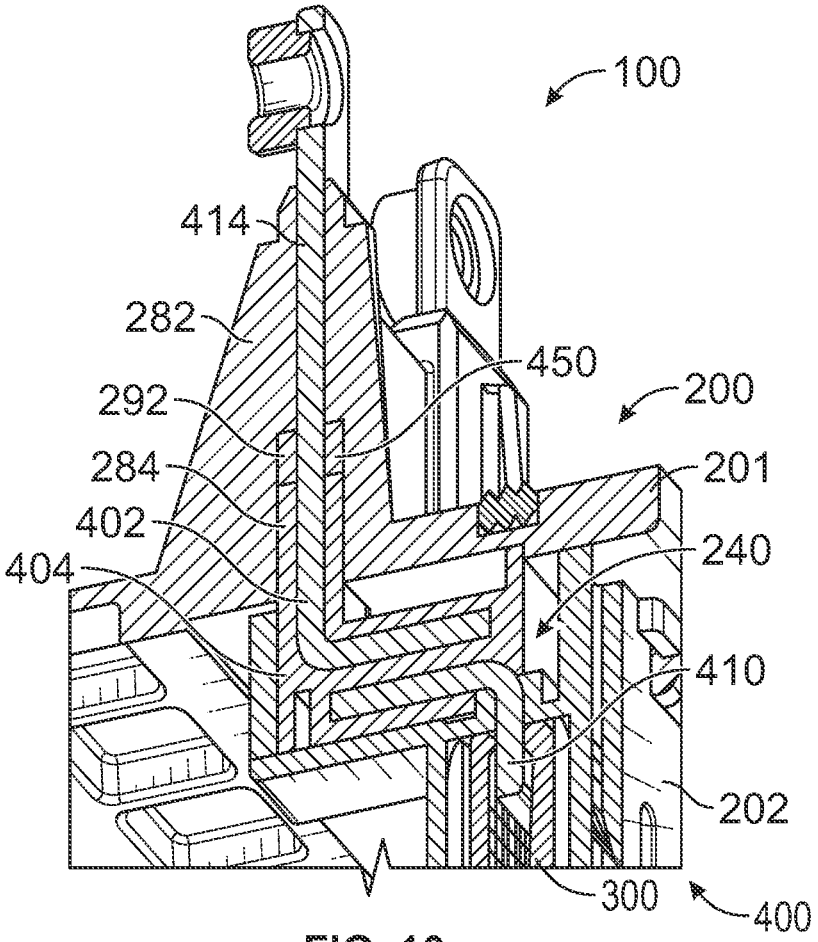
FIG. 10 is a cross sectional view of a portion of the header power connector in accordance with an exemplary embodiment.
Figure 11:
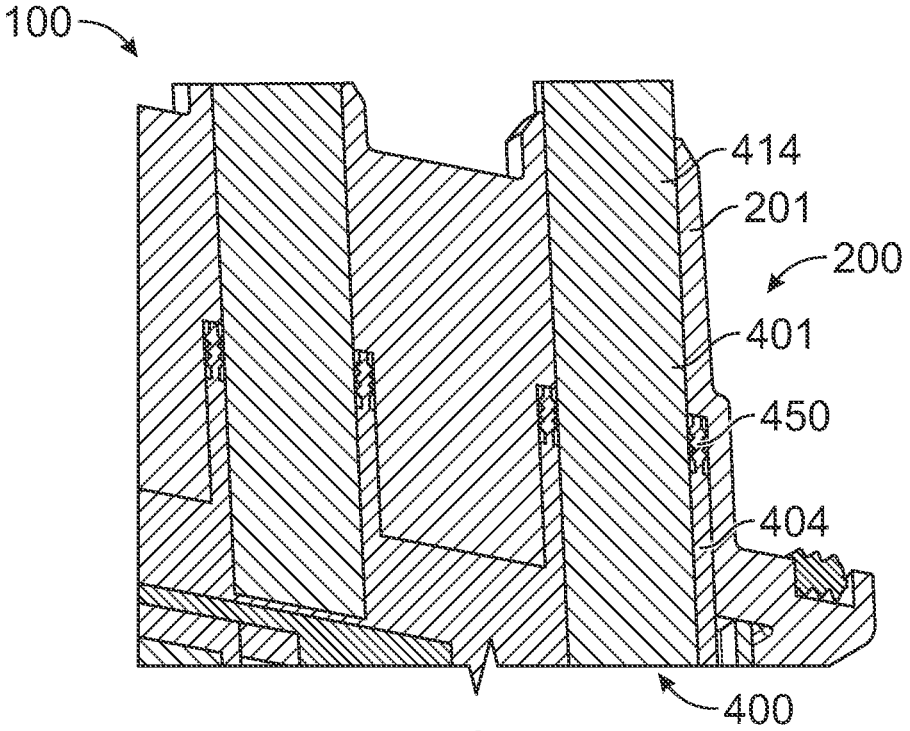
FIG. 11 is a cross sectional view of a portion of the header power connector in accordance with an exemplary embodiment.

FIG. 10 is a cross sectional view of a portion of the header power connector 100 in accordance with an exemplary embodiment. FIG. 11 is a cross sectional view of a portion of the header power connector 100 in accordance with an exemplary embodiment. FIGS. 10 and 11 illustrate the header busbar assembly 400 coupled between the upper housing portion 201 and the lower housing portion 202. The header busbar positioner 404 is located in the pocket 240 in the lower housing portion 202.

When assembled, the header busbars 402 are electrically connected to the terminals 300. The mating tabs 410 extend into the lower housing portion 202 to mate with the terminals 300. The terminating tabs 414 extend through the busbar cavities 292. For example, the terminating tabs 414 extend through the towers 282. The extensions 438 extend into the busbar cavities 292. The busbar seals 450 are received in the busbar cavities 292 in sealing engagement with the header busbar 402 and in sealing engagement with the upper housing portion 201.

Figure 12:
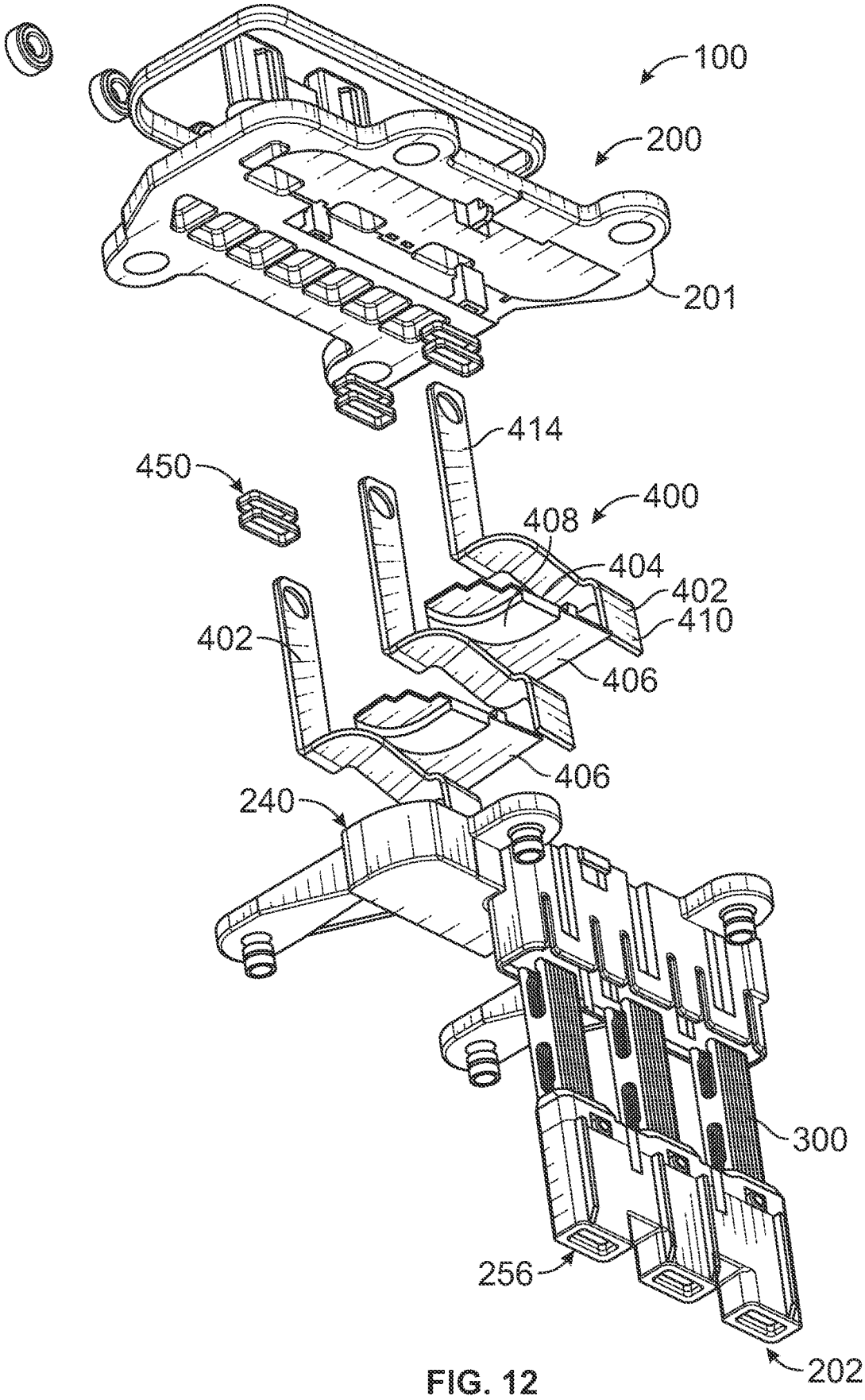
FIG. 12 is a bottom perspective, exploded view of the header power connector in accordance with an exemplary embodiment.

FIG. 12 is a bottom perspective, exploded view of the header power connector 100 in accordance with an exemplary embodiment. In the illustrated embodiment, the header busbar positioner 404 is a multipiece structure. The header busbar positioner 404 includes spacer plates 406 configured to be positioned between the header busbars 402. The spacer plates 406 position the header busbars 402 relative to each other. The spacer plates 406 electrically isolate the header busbars 402 from each other. The spacer plates 406 include locating features 408, such as pockets, grooves, shoulders, tabs, rails, ribs, and the like used to locate the header busbars 402 relative to the spacer plates 406.

During assembly, the header busbars 402 and the spacer plates 406 are configured to be received in the header housing assembly 200 between the upper housing portion 201 and the lower housing portion 202. For example, the header busbar assembly 400 is received in the pocket 240 of the lower housing portion 202. The mating tabs 410 extend into the terminal cavities 256 to mate with the corresponding terminals 300. The terminating tabs 414 extend from the extensions 438 into the upper housing portion 201. The busbar seals 450 are configured to be coupled to the terminating tabs 414 and provide sealing through the interior of the header power connector 100.

Figure 13:
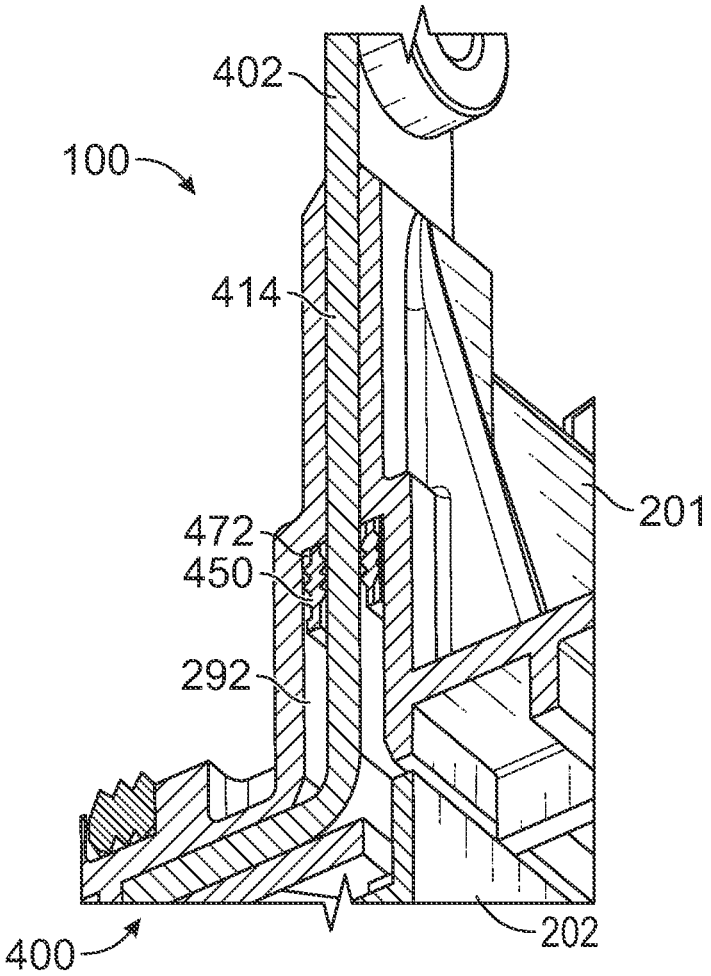
FIG. 13 is a cross sectional view of a portion of the header power connector in accordance with an exemplary embodiment.
Figure 14:
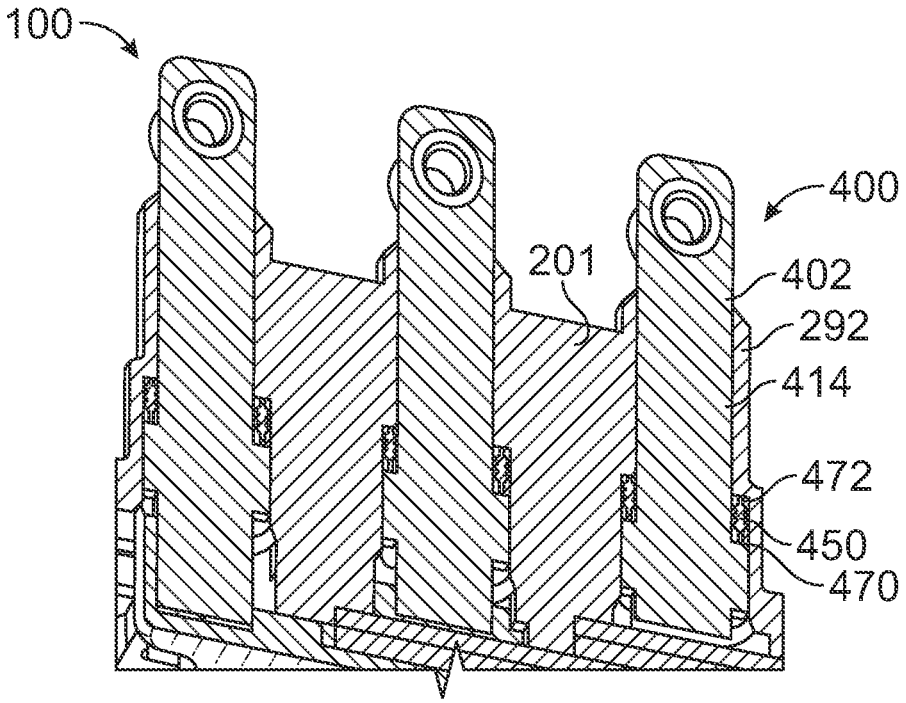
FIG. 14 is a cross sectional view of a portion of the header power connector in accordance with an exemplary embodiment.

FIG. 13 is a cross sectional view of a portion of the header power connector 100 in accordance with an exemplary embodiment. FIG. 14 is a cross sectional view of a portion of the header power connector 100 in accordance with an exemplary embodiment. FIGS. 13 and 14 illustrate the header busbar assembly 400 coupled between the upper housing portion 201 and the lower housing portion 202. The mating tabs 410 extend into the lower housing portion 202 to mate with the terminals 300. The terminating tabs 414 extend through the busbar cavities 292 and the busbar seals 450 are received in the busbar cavities 292 in sealing engagement with the header busbar 402 and the upper housing portion 201.

In an exemplary embodiment, the header busbars 402 include shoulders 470 along the side edges of the terminating tabs 414. The busbar seals 450 engage the shoulders 470. The shoulders 470 may be used to press the busbar seals 450 into the busbar cavities 292. The shoulders 470 may compress the busbar seals 450 against housing shoulders 472 of the upper housing portion 202.

Figure 15:
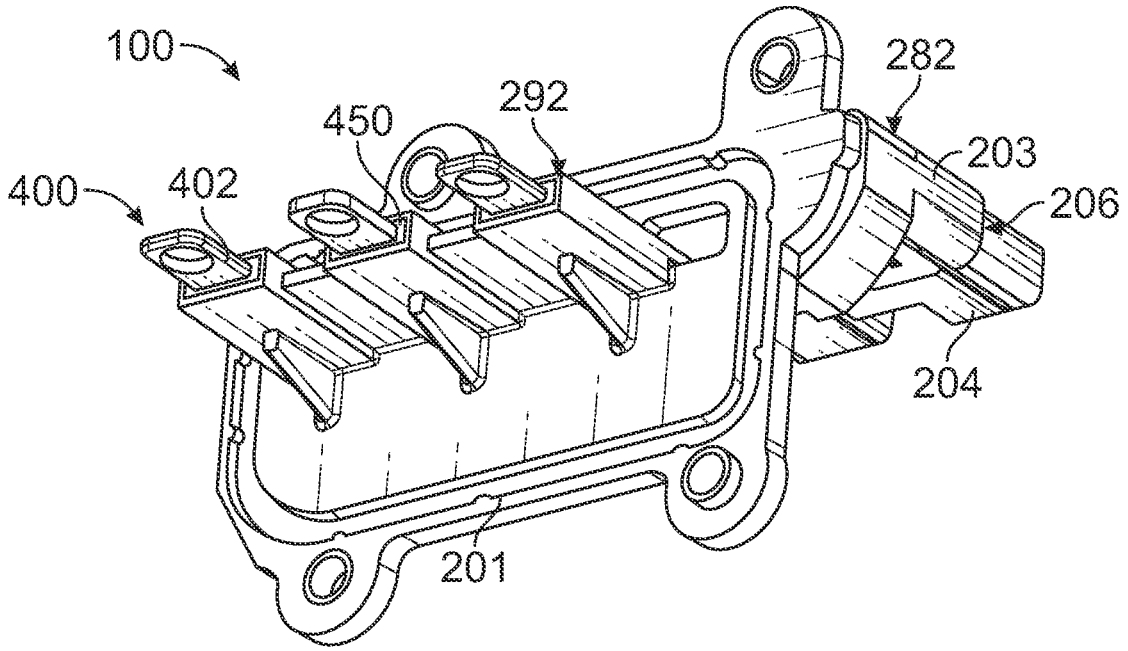
FIG. 15 is a top perspective view of the header power connector in accordance with an exemplary embodiment.
Figure 16:
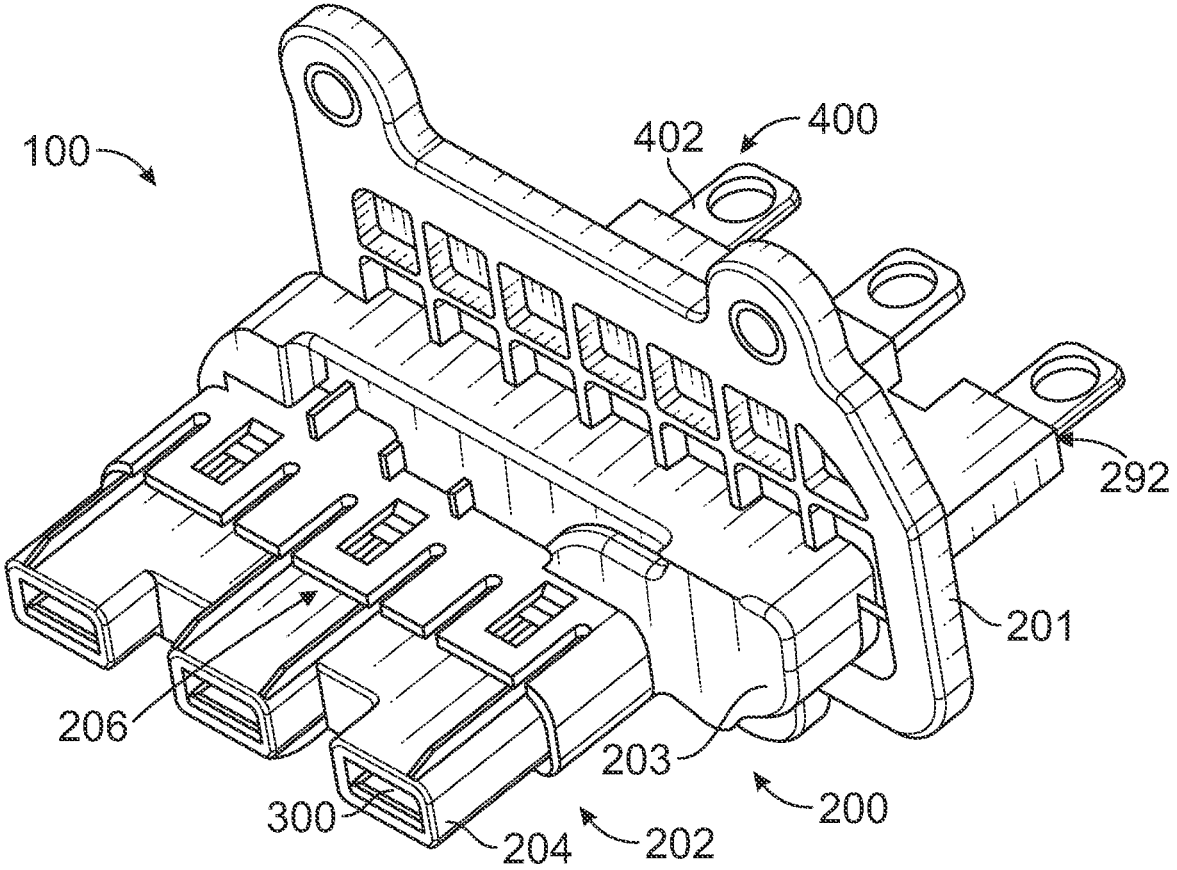
FIG. 16 is a bottom perspective view of the header power connector in accordance with an exemplary embodiment.
Figure 17:
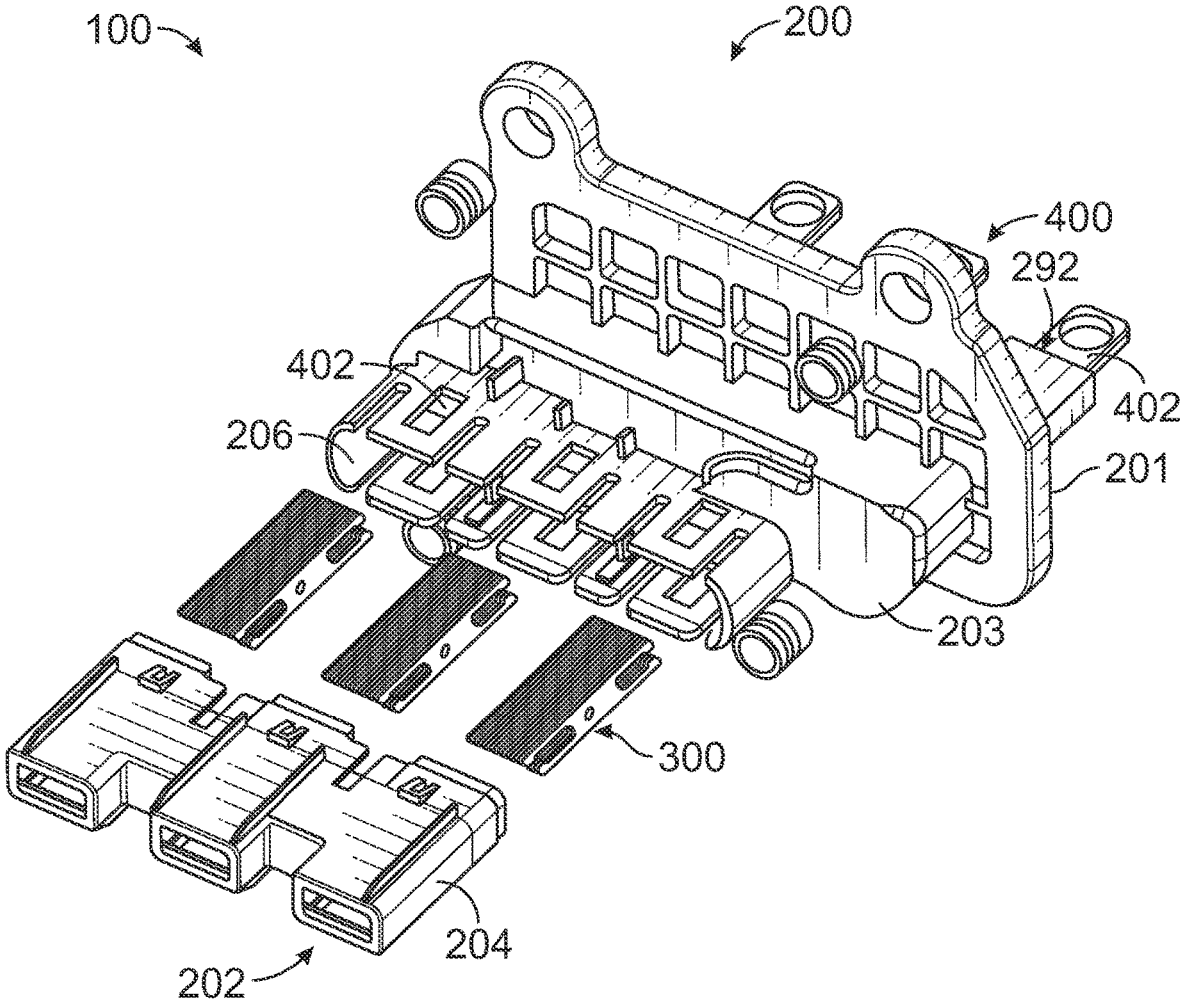
FIG. 17 is a bottom perspective, exploded view of the header power connector in accordance with an exemplary embodiment.

FIG. 15 is a top perspective view of the header power connector 100 in accordance with an exemplary embodiment. FIG. 16 is a bottom perspective view of the header power connector 100 in accordance with an exemplary embodiment. FIG. 17 is a bottom perspective, exploded view of the header power connector 100 in accordance with an exemplary embodiment.

In an exemplary embodiment, the upper housing portion 201 is integral with the outer housing 203 of the lower housing portion 202. For example, the upper housing portion 201 and the outer housing 203 are co-molded during a molding process. The upper housing portion 201 and the outer housing 203 are molded around the header busbar assembly 400. When co-molded, the header busbars 402 may be held by a tool during the molding process. The molded material may separate and hold the header busbars 402 relative to each other. The molded material may be sealed against the header busbars 402. The header busbar assembly 400 may be contained within the interior of the upper housing portion 201 and the outer housing 203. During assembly, the inner housing 204 is received in the cavity 206 of the outer housing 203 at the bottom of the header housing assembly 200. The terminals 300 are held in the inner housing 204 and the cavity 206 between the inner housing 204 and the outer housing 203.

In various embodiments, the busbar seals 450 (FIG. 15) are received in the busbar cavities 292 to provide sealing to the upper housing portion 201 and the header busbars 402. The busbar seals 450 may be loaded into the busbar cavities 292 after the upper housing portion 201 is molded around the header busbars 402. In alternative embodiments, the busbar seals 450 are formed in place in the busbar cavities 292. For example, the busbar seals 450 may be potting material or injection molding material molded in place in the busbar cavities 292 around the header busbars 402. In alternative embodiments, the header power connector 100 may be provided without the busbar seals 450. For example, when the housing portions are molded around the header busbars 402, the molded material may be sealed to the header busbars 402.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A header power connector comprising:

a header housing assembly including an upper housing portion and a lower housing portion, the upper housing portion including a busbar cavity including busbar cavities, the lower housing portion including terminal cavities having ports open to the terminal cavities configured to receive first busbars associated with a first electrical component;

terminals received in the corresponding terminal cavities, each terminal including an upper mating end having an upper socket and a lower mating end having a lower socket, the lower socket is configured to receive the corresponding first busbar to electrically connect the terminal to the first busbar;

a header busbar assembly received in the header housing assembly between the upper housing portion and the lower housing portion, the header busbar assembly including header busbars and a header busbar positioner coupled to the header busbars to position the header busbars relative to each other, each header busbar including a mating tab at a mating end and a terminating tab at a terminating end opposite the mating end, the mating tab extending into the terminal cavity to mate with the corresponding terminal, the terminating tabs passing through the busbar cavities and extending from the upper housing portion for connection to second busbars associated with a second electrical component, wherein the header busbars and the terminals are configured to electrically connect the first busbars and the second busbars; and busbar seals received in the busbar cavities to seal against the header busbars and seal against the upper housing portion.

2. The header power connector of claim 1, wherein the busbar seals are preformed and coupled to the header busbars prior to loading the header busbars into the busbar cavities.

3. The header power connector of claim 1, wherein the busbar seals are formed in situ in the busbar cavities after the header busbars are loaded into the busbar cavities.

4. The header power connector of claim 1, wherein each busbar seal includes an inner sealing surface interfacing with the header busbar and an outer sealing surface interfacing with the upper housing portion.

5. The header power connector of claim 1, wherein the header busbar positioner separates the header busbars from each other to electrically isolate the header busbars.

6. The header power connector of claim 1, wherein the header busbar positioner is received in a pocket between the upper housing portion and the lower housing portion.

7. The header power connector of claim 1, wherein the lower housing portion is coupled to the upper housing portion using fasteners.

8. The header power connector of claim 1, wherein the lower housing portion includes an inner housing portion and an outer housing portion separate and discrete from the inner housing portion, the outer housing portion including a cavity, the inner housing portion being received in the cavity and coupled to the outer housing portion.

9. The header power connector of claim 8, wherein the outer housing portion is integral with the upper housing portion.

10. The header power connector of claim 1, wherein the upper housing portion includes an exterior seal surface, the header power connector further comprising a component seal sealingly coupled to the exterior seal surface, the component seal configured to seal against the first electrical component.

11. The header power connector of claim 1, wherein the terminal includes a terminal base, the upper mating end located at a first side of the terminal base, the lower mating end located at a second side of the terminal base, the upper socket flanked by a first upper spring beam and a second upper spring beam, the lower socket flanked by a first lower spring beam and a second lower spring beam, the first and second upper spring beams configured to engage opposite sides of the header busbar, the first and second lower spring beams configured to engage opposite sides of the second busbar.

12. The header power connector of claim 1, wherein the terminal is a first terminal in a terminal stack having a plurality of terminals, the plurality of terminals being identical to the first terminal.

13. A header power connector comprising:

a header housing assembly including an upper housing portion and a lower housing portion, the upper housing portion including a busbar cavity including busbar cavities, the lower housing portion including terminal cavities having ports open to the terminal cavities configured to receive first busbars associated with a first electrical component;

terminals received in the corresponding terminal cavities, each terminal including an upper mating end having an upper socket and a lower mating end having a lower socket, the lower socket is configured to receive the corresponding first busbar to electrically connect the terminal to the first busbar; and a header busbar assembly received in the header housing assembly between the upper housing portion and the lower housing portion, the header busbar assembly including header busbars and a header busbar positioner coupled to the header busbars to position the header busbars relative to each other, each header busbar including a mating tab at a mating end and a terminating tab at a terminating end opposite the mating end, the mating tab extending into the terminal cavity to mate with the corresponding terminal along a first tab axis, the terminating tabs passing through the busbar cavities along a second tab axis offset from the first tab axis, the terminating tabs extending from the upper housing portion for connection to second busbars associated with a second electrical component, wherein the header busbars and the terminals are configured to electrically connect the first busbars and the second busbars.

14. The header power connector of claim 13, wherein the mating tab includes a front, a rear, a first side, and a second side and wherein the terminating tab includes a front, a rear, a first side, and a second side, the mating tab being offset forwardly relative to the terminating tab such that the front of the mating tab is forward of the front of the terminating tab.

15. The header power connector of claim 13, wherein the mating tab includes a front, a rear, a first side, and a second side and wherein the terminating tab includes a front, a rear, a first side, and a second side, the mating tab and the terminating tab being offset side-to-side such that the first side and the second side of the mating tab are offset relative to the first side and the second side of the terminating tab.

16. The header power connector of claim 13, further comprising busbar seals received in the busbar cavities to seal against the header busbars and seal against the upper housing portion.

17. The header power connector of claim 13, wherein the upper housing portion includes an exterior seal surface, the header power connector further comprising a component seal sealingly coupled to the exterior seal surface, the component seal configured to seal against the first electrical component.

18. The header power connector of claim 13, wherein the lower housing portion includes an inner housing portion and an outer housing portion separate and discrete from the inner housing portion, the outer housing portion including a cavity, the inner housing portion being received in the cavity and coupled to the outer housing portion.

19. A header power connector comprising:

a header housing assembly including an upper housing portion and a lower housing portion, the upper housing portion including a busbar cavity including busbar cavities, the lower housing portion including an inner housing portion and an outer housing portion, the inner housing portion being separate and discrete from the outer housing portion and being coupled to the outer housing portion, the outer housing portion being integral with the upper housing portion, the inner housing portion including terminal cavities having ports open to the terminal cavities configured to receive first busbars associated with a first electrical component;

terminals received in the corresponding terminal cavities and held between the inner housing portion and the outer housing portion, each terminal including an upper mating end having an upper socket and a lower mating end having a lower socket, the lower socket is configured to receive the corresponding first busbar to electrically connect the terminal to the first busbar; and a header busbar assembly received in the header housing assembly between the upper housing portion and the lower housing portion, the header busbar assembly including header busbars and a header busbar positioner coupled to the header busbars to position the header busbars relative to each other, each header busbar including a mating tab at a mating end and a terminating tab at a terminating end opposite the mating end, the mating tab extending into the terminal cavity to mate with the corresponding terminal, the terminating tabs passing through the busbar cavities and extending from the upper housing portion for connection to second busbars associated with a second electrical component, wherein the header busbars and the terminals are configured to electrically connect the first busbars and the second busbars.

20. The header power connector of claim 19, wherein the outer housing portion is co-molded with the upper housing portion around the header busbars and the header busbar positioner.

* * * * *